US006169814B1

(12) United States Patent
Johnson

(10) Patent No.: US 6,169,814 B1
(45) Date of Patent: Jan. 2, 2001

(54) FETAL COMMUNICATION DEVICE

(76) Inventor: Marsha D. Johnson, 50 Kinsman View Cir., Silver Spring, MD (US) 20901

( * ) Notice: Under 35 U.S.C. 154(b), the term of this patent shall be extended for 0 days.

(21) Appl. No.: 09/141,531

(22) Filed: Aug. 27, 1998

(51) Int. Cl.[7] ..... H04R 1/02
(52) U.S. Cl. ..... 381/333; 381/386; 381/388
(58) Field of Search ..... 381/333, 385, 381/386, 332

(56) References Cited

U.S. PATENT DOCUMENTS

| | | | | |
|---|---|---|---|---|
| 4,830,007 | * | 5/1989 | Stein | 128/421 |
| 5,109,421 | * | 4/1992 | Fox | 381/333 |
| 5,699,558 | * | 12/1997 | Min | 2/48 |
| 5,764,776 | * | 6/1998 | Francais | 381/300 |

* cited by examiner

*Primary Examiner*—Forester W. Isen
*Assistant Examiner*—Brian Tyrone Pendleton

(57) ABSTRACT

A fetal communication device for permitting a user to aurally communicate with a fetus includes a housing designed for resting on the belly of a pregnant mother with a pair of elongate flexible straps coupled to the housing designed for extending across the belly of a pregnant mother. An elongate flexible attachment strap is attached a first strap of the pair of straps and is designed for wrapping around the back of the pregnant mother to hold the housing to the belly of the pregnant mother. An amplifier for amplifying signals is provided in the housing. A microphone is electrically connected to the amplifier. The straps each have a plurality of speakers electrically connected to the amplifier. The speakers are designed for resting against the belly of the pregnant mother to permit transmission of sounds from the speakers into the womb of the pregnant mother.

14 Claims, 4 Drawing Sheets

FETAL COMMUNICATION DEVICE

BACKGROUND OF THE INVENTION

1. Field of the Invention

The present invention relates to fetal communication devices and more particularly pertains to a new fetal communication device for permitting a user to aurally communicate with a fetus.

2. Description of the Prior Art

The use of fetal communication devices is known in the prior art. More specifically, fetal communication devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,768,612; U.S. Pat. No. 4,187,635; U.S. Pat. No. 4,898,179; U.S. Pat. No. Des. 297,234; U.S. Pat. No. 2,099,871; and U.S. Pat. No. 4,685,448.

While these devices fulfill their respective, particular objectives and requirements, the aforementioned patents do not disclose a new fetal communication device. The inventive device includes a housing designed for resting on the belly of a pregnant mother with a pair of elongate flexible straps coupled to the housing designed for extending across the belly of a pregnant mother. An elongate flexible attachment strap is attached a first strap of the pair of straps and is designed for wrapping around the back of the pregnant mother to hold the housing to the belly of the pregnant mother. An amplifier for amplifying signals is provided in the housing. A microphone is electrically connected to the amplifier. The straps each have a plurality of speakers electrically connected to the amplifier. The speakers are designed for resting against the belly of the pregnant mother to permit transmission of sounds from the speakers into the womb of the pregnant mother.

In these respects, the fetal communication device according to the present invention substantially departs from the conventional concepts and designs of the prior art, and in so doing provides an apparatus primarily developed for the purpose of for permitting a user to aurally communicate with a fetus.

SUMMARY OF THE INVENTION

In view of the foregoing disadvantages inherent in the known types of fetal communication devices now present in the prior art, the present invention provides a new fetal communication device construction wherein the same can be utilized for permitting a user to aurally communicate with a fetus.

The general purpose of the present invention, which will be described subsequently in greater detail, is to provide a new fetal communication device apparatus and method which has many of the advantages of the fetal communication devices mentioned heretofore and many novel features that result in a new fetal communication device which is not anticipated, rendered obvious, suggested, or even implied by any of the prior art fetal communication devices, either alone or in any combination thereof.

To attain this, the present invention generally comprises a housing designed for resting on the belly of a pregnant mother with a pair of elongate flexible straps coupled to the housing designed for extending across the belly of a pregnant mother. An elongate flexible attachment strap is attached a first strap of the pair of straps and is designed for wrapping around the back of the pregnant mother to hold the housing to the belly of the pregnant mother. An amplifier for amplifying signals is provided in the housing. A microphone is electrically connected to the amplifier. The straps each have a plurality of speakers electrically connected to the amplifier. The speakers are designed for resting against the belly of the pregnant mother to permit transmission of sounds from the speakers into the womb of the pregnant mother.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fetal communication device apparatus and method which has many of the advantages of the fetal communication devices mentioned heretofore and many novel features that result in a new fetal communication device which is not anticipated, rendered obvious, suggested, or even implied by any of the prior art fetal communication devices, either alone or in any combination thereof.

It is another object of the present invention to provide a new fetal communication device which may be easily and efficiently manufactured and marketed.

It is a further object of the present invention to provide a new fetal communication device which is of a durable and reliable construction.

An even further object of the present invention is to provide a new fetal communication device which is susceptible of a low cost of manufacture with regard to both materials and labor, and which accordingly is then susceptible of low prices of sale to the consuming public, thereby making such fetal communication device economically available to the buying public.

Still yet another object of the present invention is to provide a new fetal communication device which provides in the apparatuses and methods of the prior art some of the advantages thereof, while simultaneously overcoming some of the disadvantages normally associated therewith.

Still another object of the present invention is to provide a new fetal communication device for permitting a user to aurally communicate with a fetus.

Yet another object of the present invention is to provide a new fetal communication device which includes a housing designed for resting on the belly of a pregnant mother with a pair of elongate flexible straps coupled to the housing designed for extending across the belly of a pregnant mother. An elongate flexible attachment strap is attached a first strap of the pair of straps and is designed for wrapping around the back of the pregnant mother to hold the housing to the belly of the pregnant mother. An amplifier for amplifying signals is provided in the housing. A microphone is electrically connected to the amplifier. The straps each have a plurality of speakers electrically connected to the amplifier. The speakers are designed for resting against the belly of the pregnant mother to permit transmission of sounds from the speakers into the womb of the pregnant mother.

Still yet another object of the present invention is to provide a new fetal communication device that lets a mother aurally communicate with a fetus in her womb.

Even still another object of the present invention is to provide a new fetal communication device that contours to the shape of the belly of a pregnant mother to provide sounds to the environment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
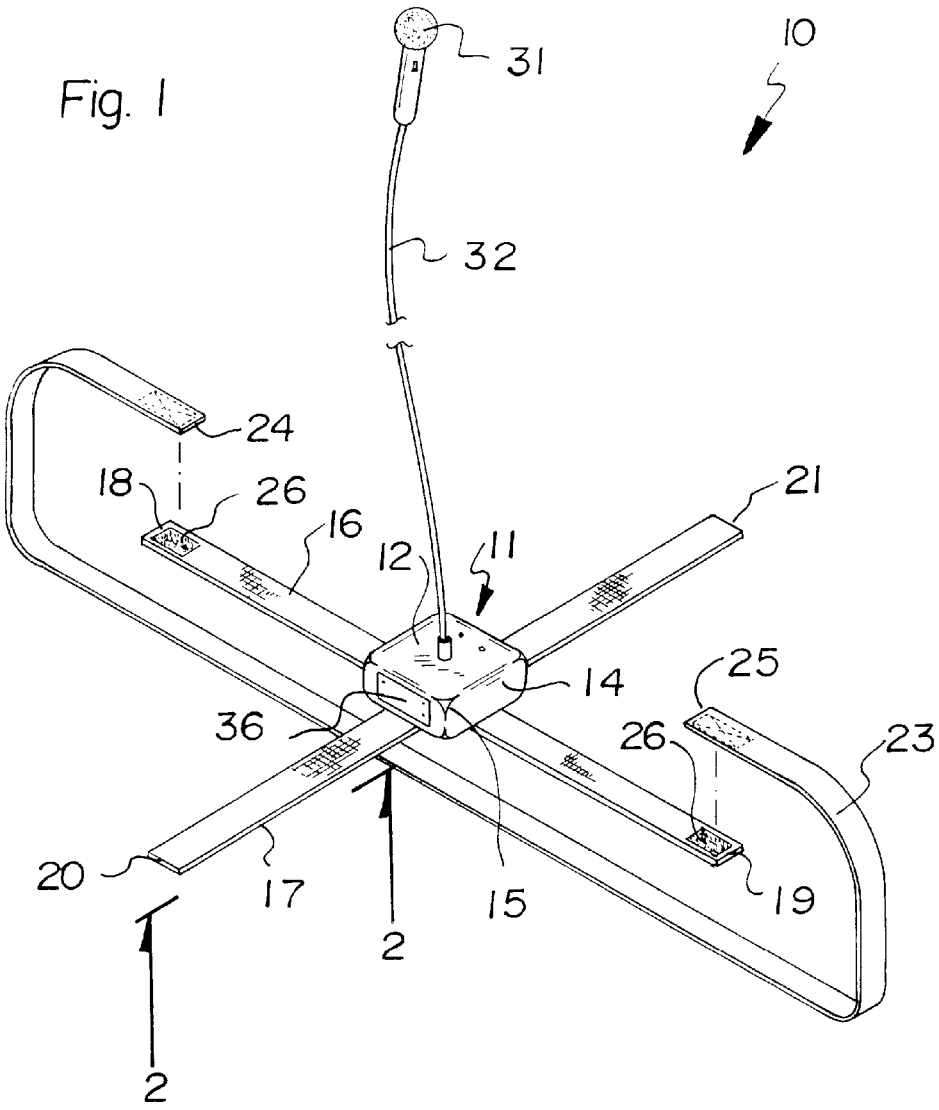
FIG. 1 is a schematic perspective view of a new fetal communication device according to the present invention.
Figure 2:
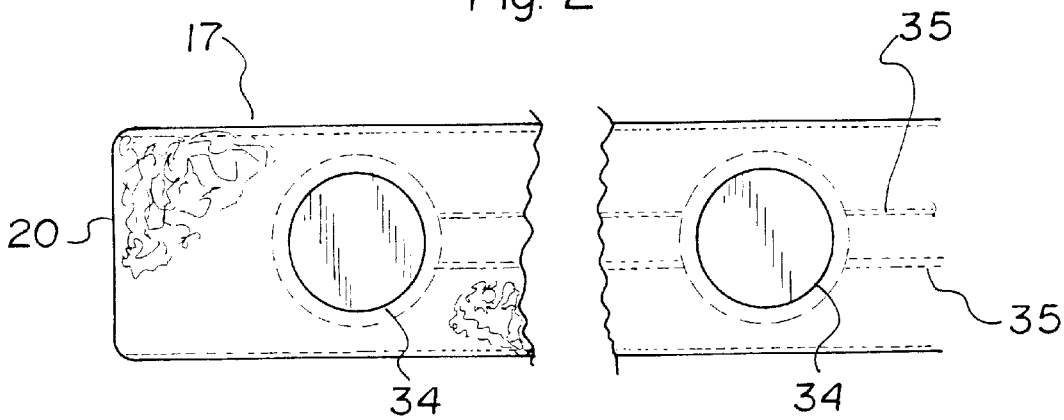
FIG. 2 is a schematic partial side view of a strap of the present invention as seen from the vantage of line 2—2 of FIG. 1.
Figure 3:
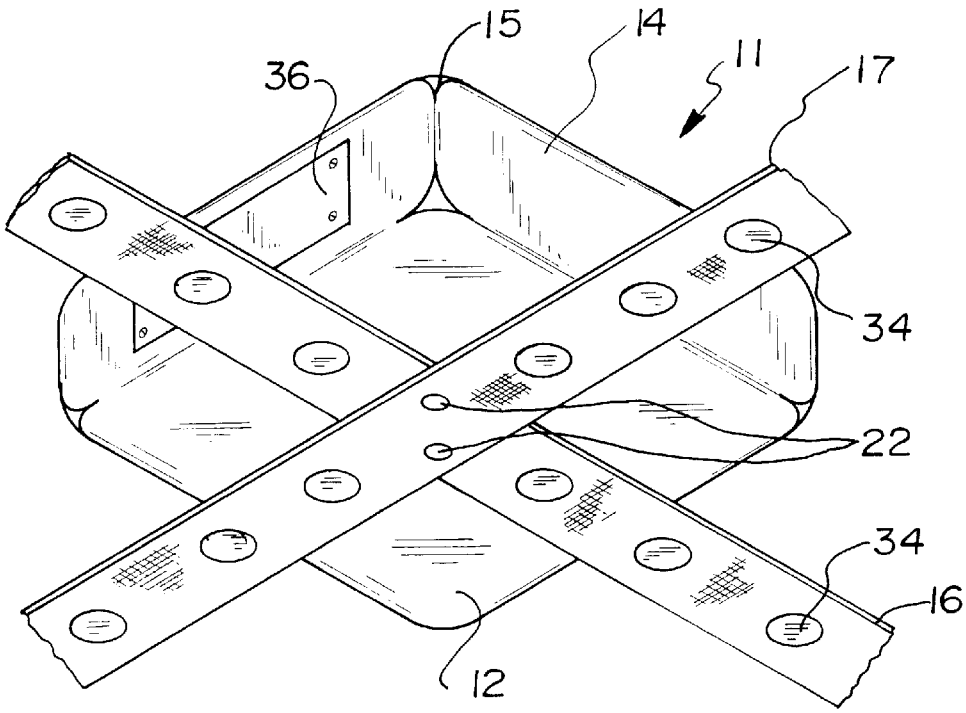
FIG. 3 is a schematic partial perspective view of the bottom face of the housing of the present invention.
Figure 4:
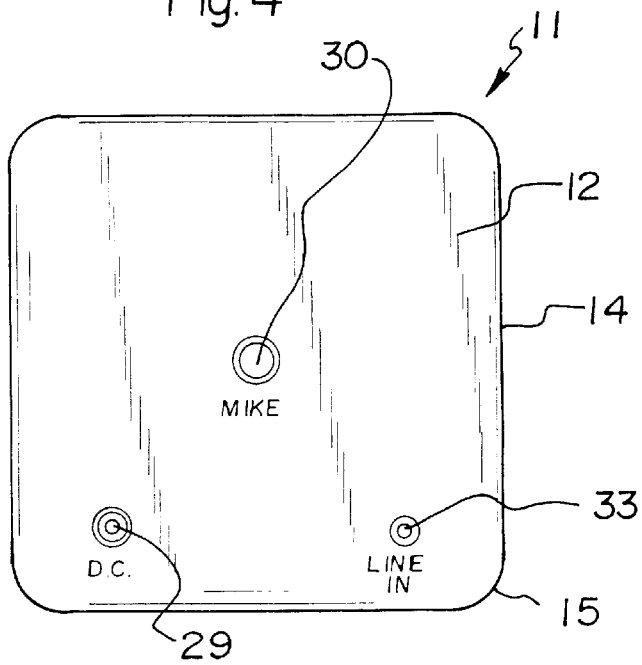
FIG. 4 is a schematic side view of the top face of the housing of the present invention.
Figure 5:
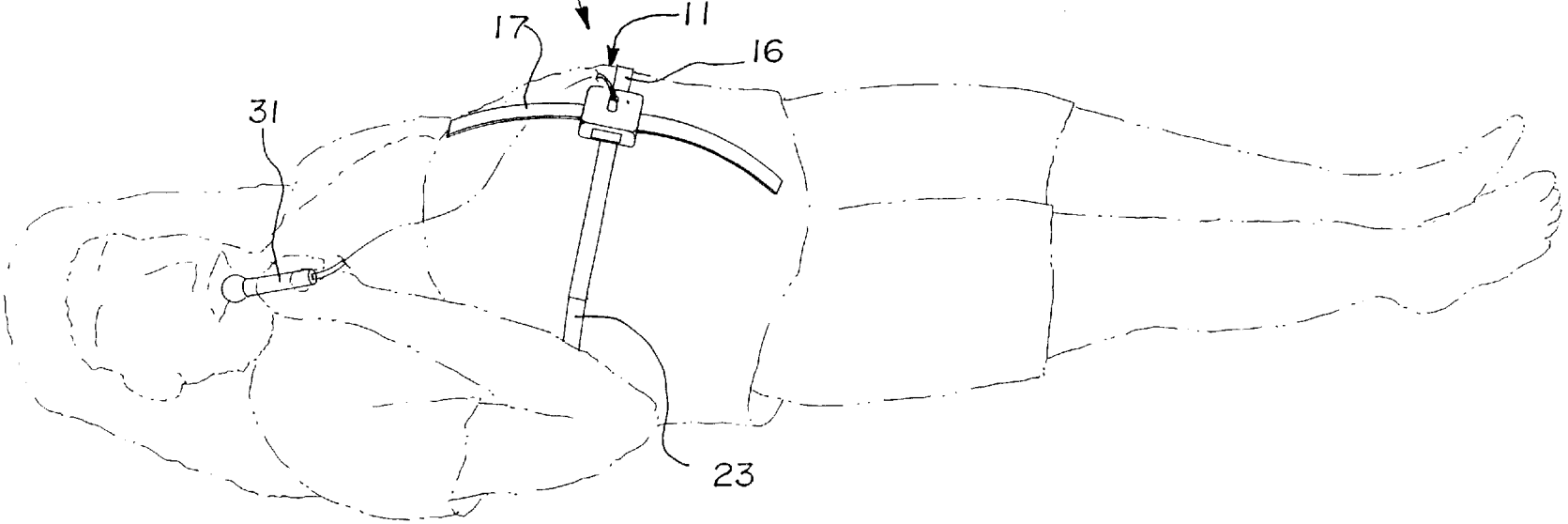
FIG. 5 is a schematic perspective view of the present invention in use on a pregnant mother.
Figure 6:
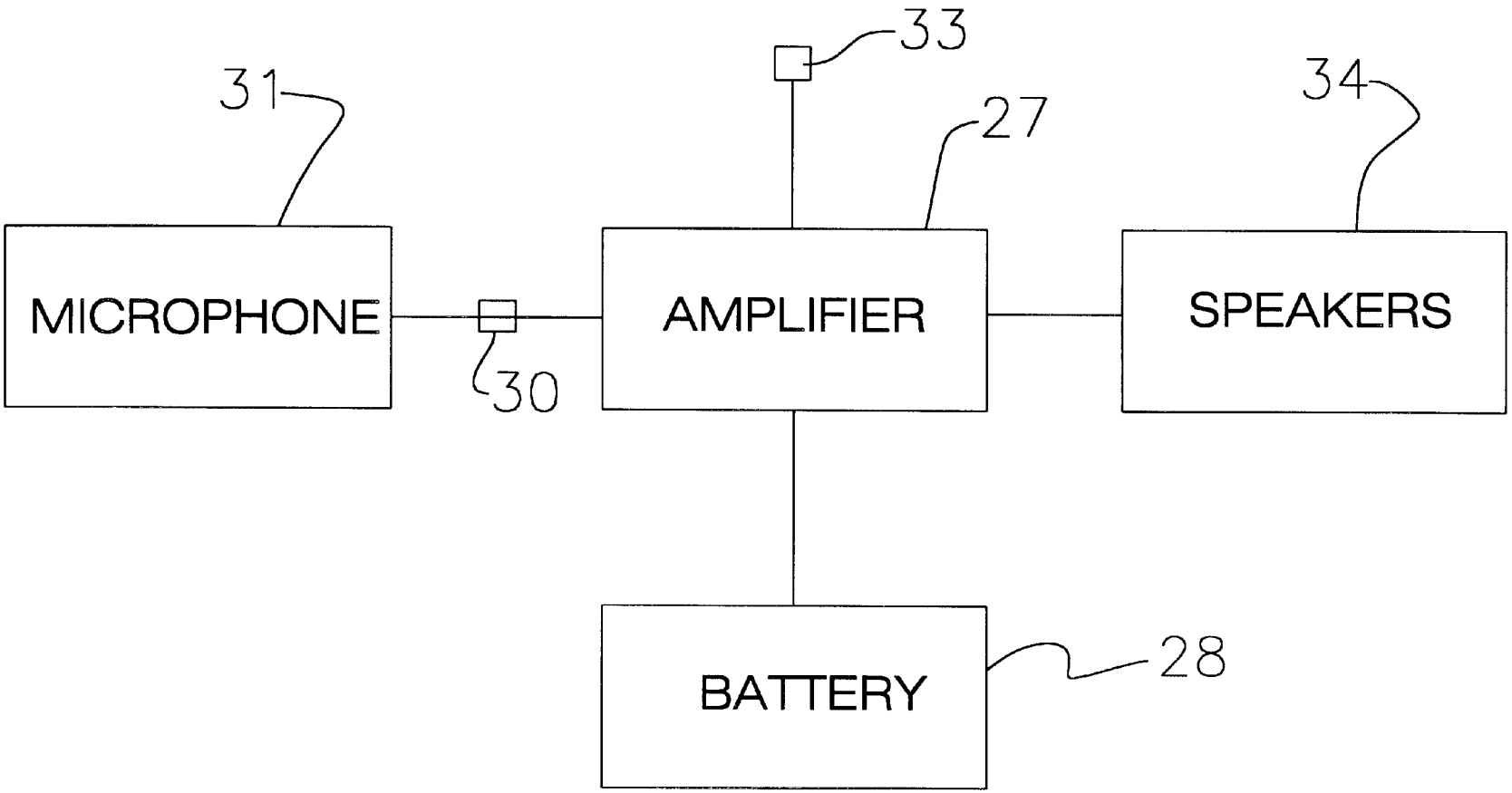
FIG. 6 is an electrical schematic of the present invention.

With reference now to the drawings, and in particular to FIGS. 1 through 6 thereof, a new fetal communication device embodying the principles and concepts of the present invention and generally designated by the reference numeral 10 will be described.

As best illustrated in FIGS. 1 through 6, the fetal communication device 10 generally comprises a housing 11 designed for resting on the belly of a pregnant mother with a pair of elongate flexible straps 16,17 coupled to the housing 11 designed for extending across the belly of a pregnant mother. An elongate flexible attachment strap 23 is attached a first strap 16 of the pair of straps 16,17 and is designed for wrapping around the back of the pregnant mother to hold the housing 11 to the belly of the pregnant mother. An amplifier 27 for amplifying signals is provided in the housing 11. A microphone 31 is electrically connected to the amplifier 27. The straps 16,17 each have a plurality of speakers 34 electrically connected to the amplifier 27. The speakers 34 are designed for resting against the belly of the pregnant mother to permit transmission of sounds from the speakers 34 into the womb of the pregnant mother.

In use, the device 10 is designed for aurally communicating with a fetus in the womb of a mother. In closer detail, the housing 11 is designed for resting on the belly of a pregnant mother. The housing 11 is generally rectangular in configuration and has top and bottom faces 12,13, four sides 14, and a plurality of corner edges 15. Preferably, the corner edges 15 are rounded to help prevent injury to a mother when the housing 11 is rested on the belly of the mother.

A pair of elongate flexible straps 16,17 are coupled to the housing. Each strap 16,17 has a pair of opposite ends 18,19,20,21, a midpoint between the ends of the respective strap and a longitudinal axis extending between the ends of the respective strap. The straps 16,17 each have a length defined between the ends of the respective strap. Ideally, the lengths of the straps 16,17 are generally equal to one another. Preferably, the midpoint of each of the straps 16,17 is generally positioned equidistant between the ends of the respective strap. The straps 16,17 are preferably coupled to the bottom face 13 of the housing 11 at the midpoints of the straps 16,17 by a pair of fasteners 22 with the longitudinal axes of the straps 16,17 extending generally perpendicular to one another such that the straps 16,17 generally form a cross shape. Preferably, the ends 18,19 of a first strap 16 of the pair of straps 16,17 are outwardly extended from a first pair of opposite sides of the housing and the ends 20,21 of a second strap 17 of the pair of straps 16,17 is outwardly extended from a second pair of opposite sides of the housing. In use, the straps 16,17 are designed for extending across the belly of a pregnant mother.

The elongate flexible attachment strap 23 has a pair of opposite ends 24,25. One of the ends of the attachment strap 23 is attached to one of the ends of the first strap 16 and the other end of the attachment strap 23 is attached to another of the ends of the first strap 16. Preferably, a hook and loop fastener 26 detachably attaches each pair of associated ends of the attachment strap 23 and the first strap 16 together. In use, the attachment strap 23 is designed for wrapping around the back of the pregnant mother to hold the housing 11 to the belly of the pregnant mother.

An amplifier 27 for amplifying signals is provided in the housing 11. A power source 28 is electrically connected to the amplifier 27 for powering the amplifier 27. The power source 28 is preferably provided in the housing 11 and ideally comprises a battery. The housing 11 preferably has a removable access panel 36 providing an opening into the housing 11 to provide a user access to the battery. In an ideal embodiment, the housing 11 has a power socket 29 in the top face 12 of the housing 11 for receiving an electrical cord to electrically connect the amplifier 27 to an external power source 28.

The housing 11 also has a first input socket 30 in the top face 12 of the housing 11. A microphone 31 for receiving aural signals from a user is electrically connected to the amplifier 27. The microphone 31 has an elongate flexible signal cord 32 is inserted into the first input socket 30 to electrically connect the microphone 31 to the amplifier 27. Preferably, the housing 11 has a second input socket 33 for electrically connecting another sound input device such as a patch cord from a stereo to the amplifier 27. The second input socket 33 is located in the top face 12 of the housing 11 for convenient access during use of the device 10.

The straps 16,17 each have a plurality of downwards facing speakers 34 electrically connected to the amplifier 27 (preferably in series) by wires for converting signals from the amplifier 27 into audible sounds. The speakers 34 of each of the straps 16,17 are spaced apart and arranged in a row extending between the ends of the respective strap. In use, the speakers 34 are designed for resting against the belly of the pregnant mother to permit transmission of sounds generated by the speakers 34 into the womb of the pregnant mother.

In use, the bottom face 13 of the housing 11 is placed against the belly of a pregnant mother. The attachment strap 23 is wrapped around the back of the pregnant mother and attached to the ends of the first strap 16 to hold the housing 11 to the belly of the pregnant mother. The first and second straps 16,17 are extended on the belly of the pregnant mother with the speaker facing towards the belly of the pregnant mother. Preferably the first strap 16 is transversely extended on the belly in a direction across the width of the pregnant mother and the second strap 17 is extended on the belly in a longitudinal direction between the head and feet of the pregnant mother. The user then speaks or sings into the microphone 31 which in turn are projected out of the speakers 34 through the amplifier 27 so that the projected sounds are transmitted to the fetus in the womb of the pregnant mother.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for communicating with a fetus in the womb of a mother, said device comprising:

a housing adapted for resting on the belly of a pregnant mother;

a pair of elongate flexible straps;

said straps being coupled to said housing;

said straps being adapted for extending across the belly of a pregnant mother;

an elongate flexible attachment strap being attached a first strap of said pair of straps;

said attachment strap being adapted for wrapping around the back of the pregnant mother to hold said housing to the belly of the pregnant mother;

an amplifier for amplifying signals being provided in said housing;

a microphone being electrically connected to said amplifier;

said straps each having a plurality of speakers electrically connected to said amplifier, said speakers being adapted for resting against the belly of the pregnant mother to permit transmission of sounds generated by said speakers into the womb of the pregnant mother; and wherein each of said pair of straps have a pair of opposite ends, a midpoint between said ends of the respective strap and a longitudinal axis extending between said ends of the respective strap, wherein said midpoint of each of said straps is generally positioned equidistant between said ends of the respective strap, said straps being coupled to said housing at said midpoints of said straps.

2. The device of claim 1, wherein said housing is generally rectangular in configuration and has top and bottom faces, four sides, and a plurality of corner edges.

3. The device of claim 2, wherein said corner edges are rounded to help prevent injury to a mother when said housing is rested on the belly of the mother.

4. The device of claim 1, wherein said straps each have a length defined between said ends of the respective strap, wherein said lengths of said straps are generally equal to one another.

5. The device of claim 1, wherein said longitudinal axes of said straps are extended generally perpendicular to one another such that said straps generally form a cross shape.

6. The device of claim 1, further comprising a power source being electrically connected to said amplifier for powering said amplifier, said power source being provided in said housing.

7. The device of claim 6, wherein said power source comprises a battery.

8. A device for communicating with a fetus in the womb of a mother, said device comprising:

a housing adapted for resting on the belly of a pregnant mother, said housing being generally rectangular in configuration and having top and bottom faces, four sides, and a plurality of corner edges, wherein said corner edges are rounded;

a pair of elongate flexible straps each having a pair of opposite ends, a midpoint between said ends of the respective strap and a longitudinal axis extending between said ends of the respective strap;

said straps each having a length defined between said ends of the respective strap, wherein said lengths of said straps are generally equal to one another;

wherein said midpoint of each of said straps is generally positioned equidistant between said ends of the respective strap;

said straps being coupled to said bottom face of said housing at said midpoints of said straps;

said longitudinal axes of said straps being extended generally perpendicular to one another such that said straps generally form a cross shape;

said ends of a first strap of said pair of straps being outwardly extended from a first pair of opposite sides of said housing, said ends of said ends of a second strap of said pair of straps being outwardly extended from a second pair of opposite sides of said housing;

said straps being adapted for extending across the belly of a pregnant mother;

an elongate flexible attachment strap having a pair of opposite ends, one of said ends of said attachment strap being attached to one of the ends of said first strap, another of said ends of said attachment strap being attached to another of said ends of said first strap;

wherein a hook and loop fastener detachably attaches each pair of associated ends of said attachment strap and said first strap together;

said attachment strap being adapted for wrapping around the back of the pregnant mother to hold said housing to the belly of the pregnant mother;

an amplifier for amplifying signals being provided in said housing;

a power source being electrically connected to said amplifier for powering said amplifier, said power source being provided in said housing, wherein said power source comprises a battery;

wherein said housing has a power socket in said top face of said housing for receiving an electrical cord to electrically connect said amplifier to an external power source;

said housing having a first input socket in said top face of said housing;

a microphone for receiving aural signals from a user being electrically connected to said amplifier, said microphone having an elongate flexible signal cord being inserted into said first input socket to electrically connect said microphone to said amplifier;

said housing having a second input socket for electrically connecting another sound input device such as a patch cord from a stereo to said amplifier, said second input socket being located in said top face of said housing; and said straps having a plurality of speakers electrically connected to said amplifier, said speakers of each of said straps being spaced apart and arranged in a row extending between said ends of the respective strap, said speakers being adapted for resting against the belly of the pregnant mother to permit transmission of sounds generated by said speakers into the womb of the pregnant mother.

9. A device for communicating with a fetus in the womb of a mother, said device comprising:

a housing adapted for resting on the belly of a pregnant mother;

a pair of elongate flexible straps;

said straps being coupled to said housing;

said straps being adapted for extending across the belly of a pregnant mother;

an elongate flexible attachment strap being attached a first strap of said pair of straps;

said attachment strap being adapted for wrapping around the back of the pregnant mother to hold said housing to the belly of the pregnant mother;

an amplifier for amplifying signals being provided in said housing;

a microphone being electrically connected to said amplifier; and wherein said longitudinal axes of said straps are extended generally perpendicular to one another such that said straps generally form a cross shape.

10. The device of claim 9, wherein said straps each have a length defined between said ends of the respective strap, wherein said lengths of said straps are generally equal to one another.

11. The device of claim 9, wherein said housing is generally rectangular in configuration and has top and bottom faces, four sides, and a plurality of corner edges.

12. The device of claim 9, wherein said corner edges are rounded to help prevent injury to a mother when said housing is rested on the belly of the mother.

13. The device of claim 9, further comprising a power source being electrically connected to said amplifier for powering said amplifier, said power source being provided in said housing.

14. The device of claim 13, wherein said power source comprises a battery.

* * * * *